US007887377B1

(12) United States Patent
Wallace

(10) Patent No.: US 7,887,377 B1
(45) Date of Patent: Feb. 15, 2011

(54) LOW CAPACITANCE AUDIO CONNECTOR PRIORITY

(76) Inventor: Henry B. Wallace, 562 Oak Hill Rd., Fincastle, VA (US) 24090

( * ) Notice: Subject to any disclaimer, the term of this patent is extended or adjusted under 35 U.S.C. 154(b) by 7 days.

(21) Appl. No.: 12/460,801

(22) Filed: Jul. 24, 2009

Related U.S. Application Data

(60) Provisional application No. 61/135,974, filed on Jul. 25, 2008.

(51) Int. Cl.
*H01R 24/04* (2006.01)

(52) U.S. Cl. ..... 439/669

(58) Field of Classification Search ..... 439/668, 439/669, 580
See application file for complete search history.

(56) References Cited

U.S. PATENT DOCUMENTS 4,751,471 A 6/1988 Dunseath, Jr.
5,759,069 A * 6/1998 Kitatani et al. ..... 439/675
6,102,730 A 8/2000 Kjeldahl et al.
7,387,531 B2 6/2008 Cook

OTHER PUBLICATIONS

Pomona Electronics, "Model 5056 & Assembly Instructions", Jul. 23, 2002, pp. 1-2, Published by Pomona Electronics, 9028 Evergreen Way, Everett, WA 98204.

Atlantic Quality Design, Inc., The Zerocap(TM) Audio Cable, Web Page http://www.aqdi.com/zerocap.htm, Printed on Jul. 24, 2009.

* cited by examiner

*Primary Examiner*—Renee S Luebke
*Assistant Examiner*—Larisa Tsukerman

(57) ABSTRACT

The low capacitance audio connector allows reduction of the interelectrode capacitance through its compatibility with driven shield techniques. This permits an entire audio cable employing these techniques to have very low total capacitance.

3 Claims, 6 Drawing Sheets

LOW CAPACITANCE AUDIO CONNECTOR PRIORITY

PRIORITY

This application claims priority through U.S. Provisional Application No. 61/135,974 filed by Henry B. Wallace on Jul. 25, 2008 for "Low Capacitance Audio Cable."

BACKGROUND OF THE INVENTION

1. Field of the Invention

The low capacitance audio connector for use on audio cables, relates to the transmission of audio information from a source (typically a guitar or musical instrument) to a sink (typically an audio amplifier) with reduced high frequency rolloff attributable to the capacitance of the connector.

2. Description of the Prior Art

An audio connector for use on an audio cable is intended to allow easy, reliable and rapid connection of an audio cable to a musical instrument or amplifier. Audio cables are fitted with connectors at each of two ends. Typical audio connectors have a coaxial construction, with a central single signal conductor surrounded by a tubular shield or ground conductor. Such connectors have capacitance between the signal conductor and shield or ground conductor. These connectors contribute capacitance to the overall capacitance of the cable assembly. For high impedance audio sources, this capacitance acts to degrade the high frequency content of the signal.

Many applications require low capacitance connectors. For example, test and measurement applications are sometimes at risk of fouled measurements due to high capacitance connectors. As a remedy, innovations have been made in the physical design of connectors. Cook (U.S. Pat. No. 7,387,531, Jun. 17, 2008) discloses a universal coaxial connector, and its features: "For many of these and other types of cable, small changes in capacitance/impedance from the connector can often cause significant changes in return loss measurements for the cable. These and other errors are minimized by various aspects of the connector 2, such as the gripping barrel 12, the drain wire 22 and the conductive disk 24, which alone and/or in combination with other features help to reduce stray and/or parasitic capacitance that could otherwise lead to measurement errors." The advantages stated are a result of optimized physical design of the connector. Such optimizations can reduce the capacitance of a connector only so much.

The telecommunications connector described in Kjeldahl, et al. (U.S. Pat. No. 6,102,730, Aug. 15, 2000) illustrates clearly a problem that is suggested by Cook, above. The problem is that the size of the connector influences greatly the parasitic capacitance of the connector: The smaller the connector, generally the larger the capacitance. Kjeldahl, et al. states, " . . . it is a desire that the connector be as small as possible, and this, of course, accentuates the capacitive coupling problem because the required small dimensions result in a small distance between the leads of the connector elements and thus a relatively high capacity between these leads." Separating the stated dependency between the capacitance of a connector and its physical geometry is highly desirable.

The interelectrode capacitance of an audio connector is typically small, on the order of 15 picofarads. This is negligible for some applications. However, in the case where the audio cable itself is operating under a capacitance reduction scheme, such as a driven shield arrangement, the capacitance of a connector at each end of the cable comprises the majority of the capacitance of the entire assembly.

Whereas driven shield arrangements are well known in the prior art as a method of capacitance mitigation, the prior art ignores the capacitance of connectors in audio applications as being negligible. Therefore one finds the prior art devoid of audio connectors specifically designed to participate in driven shield capacitance reduction methods.

Such a driven shield arrangement as applied to a cable requires three conductors, typically in a triaxial configuration. A center conductor carries the signal of interest. A second conductor is arranged as a shield around the center conductor, separated by a first dielectric. An optional semiconductive layer situated around the outer surface of the first dielectric helps to reduce noise caused by mechanical motion of the cable's components (not shown in the figures). A third conductor is typically arranged as an additional shield, situated around the second conductor shield, separated by a second dielectric as well, though the third conductor could be a single wire insulated from the second conductor shield. The second conductor functions as a driven shield and is connected to the output of a unity gain amplifier, or more generally a transfer function of equal to or less than unity gain, whose input is connected to the center conductor. The ground reference is the third conductor.

(Note that the noninverting unity gain amplifier effectively has it's output and input coupled together through the capacitance in the audio cable. While technically a unity gain amplifier would oscillate under these conditions, in practicality a unity gain amplifier sees a loop gain slightly less than one due to imperfections in the system, such as conductor resistance and a finite amplifier output impedance, so that the system does not oscillate. Please note that while the term "unity gain" is used herein, it should always be understood that the loop gain must be less than one to ensure no oscillations will occur.)

The connectors on a reduced capacitance cable, which uses the driven shield technique, are in the prior art either a) two conductor connectors, which do not participate in the driven shield capacitance reduction happening along the length of the cable, thus adding some parasitic capacitance of their own, or b) three-conductor connectors which carry the driven shield through the connector, having their capacitance reduced, but exposing the driven shield signal to the outside world.

As an example of the former, Dunseath, Jr. (U.S. Pat. No. 4,751,471, Jun. 14, 1988) discloses a driven shield cable with a connector: "As shown in FIG. 2, the lead wire connector 9 is a miniature phone plug with the output signal and battery common (ground) connected to the plug." The referenced connector is a standard prior art device and is not able to participate in the driven shield capacitance reduction technique applied to the cable.

An example of the latter three-conductor device is a standard triaxial cable connector, such as that marketed by Pomona Electronics as the model 5056 male connector. This connector has three conductors and can participate in the driven shield capacitance reduction technique. However, the driven shield signal is exposed to the outside world, and the connector is not designed to be connected to a mating two-conductor connector.

Adding a third shielding conductor to each connector on a cable allows the driven shield electronics to eliminate the capacitance of the connectors as well, reducing the capacitance of the entire cable assembly to just a few picofarads. Hiding the driven shield conductors at the mating surfaces of one or both connectors permits connection to preexisting two-conductor equipment while gaining the benefits of low capacitance cabling and connectors. This technique is not taught in the prior art. Additionally, applying the driven shield technique to connector as well as cable eliminates the interdependency of capacitance and connector geometry.

OBJECTS AND ADVANTAGES OF THE LOW CAPACITANCE AUDIO CONNECTOR

Several objects and advantages of the low capacitance audio connector are:

1. The additional, third conductor and structure of the connectors reduces the capacitance of an entire driven shield cable assembly to the minimum practically attainable value.
2. Use of low capacitance audio connectors increases the cost of the cable assembly by a negligible amount.
3. The low capacitance audio connector can be made to appear externally identical to standard audio connectors, requiring no user education.
4. The low capacitance audio connector can be made internally similar to standard three-conductor audio connectors, requiring no special assembly techniques or equipment.
5. Decoupling the capacitance of the connector from its physical geometry is attained through the use of a driven shield technique, allowing flexibility in the construction of the low capacitance audio connector.

SUMMARY OF THE INVENTION

The low capacitance audio connector is structured to participate in driven shield audio cable systems to reduce the capacitance of the overall cable assembly to the minimum practically attainable value.

DETAILED DESCRIPTION

Driven shield arrangements require three conductors in a cable, typically a triaxial cable with a center conductor and two shields, or a center conductor and one shield and a ground return conductor, as described above. With this arrangement, a unity gain amplifier samples the signal on the center conductor and drives that signal into the second, or driven shield.

Figure 1:
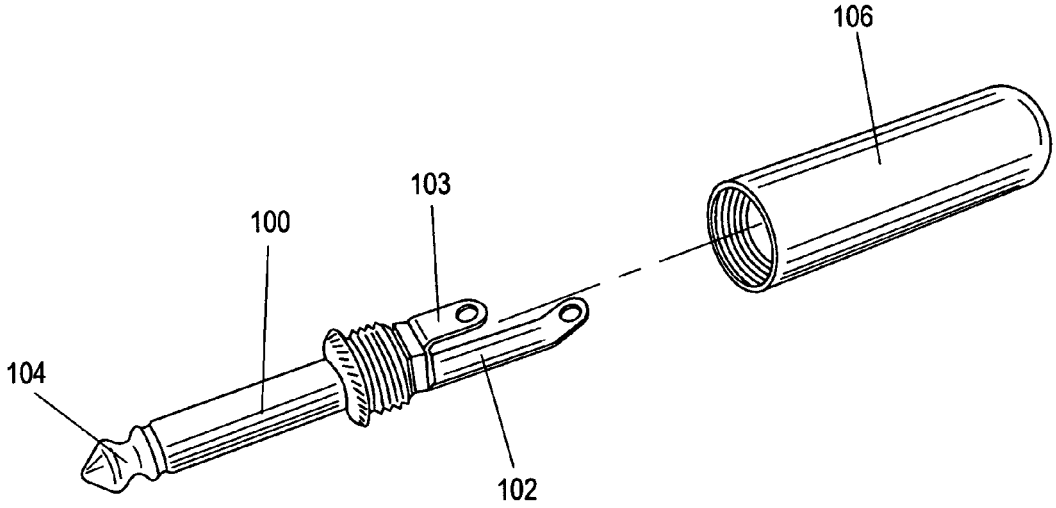
FIG. 1 (PRIOR ART)
FIG. 1 is a drawing of a typical two-conductor audio connector.

FIG. 1 illustrates a perspective view of a typical male audio connector showing a machined metal body 100 serving as a ground return contact, a signal contact 104, a metallic terminal 102 which is connected internally to ground return contact 100, a second metallic terminal 103 which is connected internally to signal contact 104, and a backshell 106.

Figure 2A:
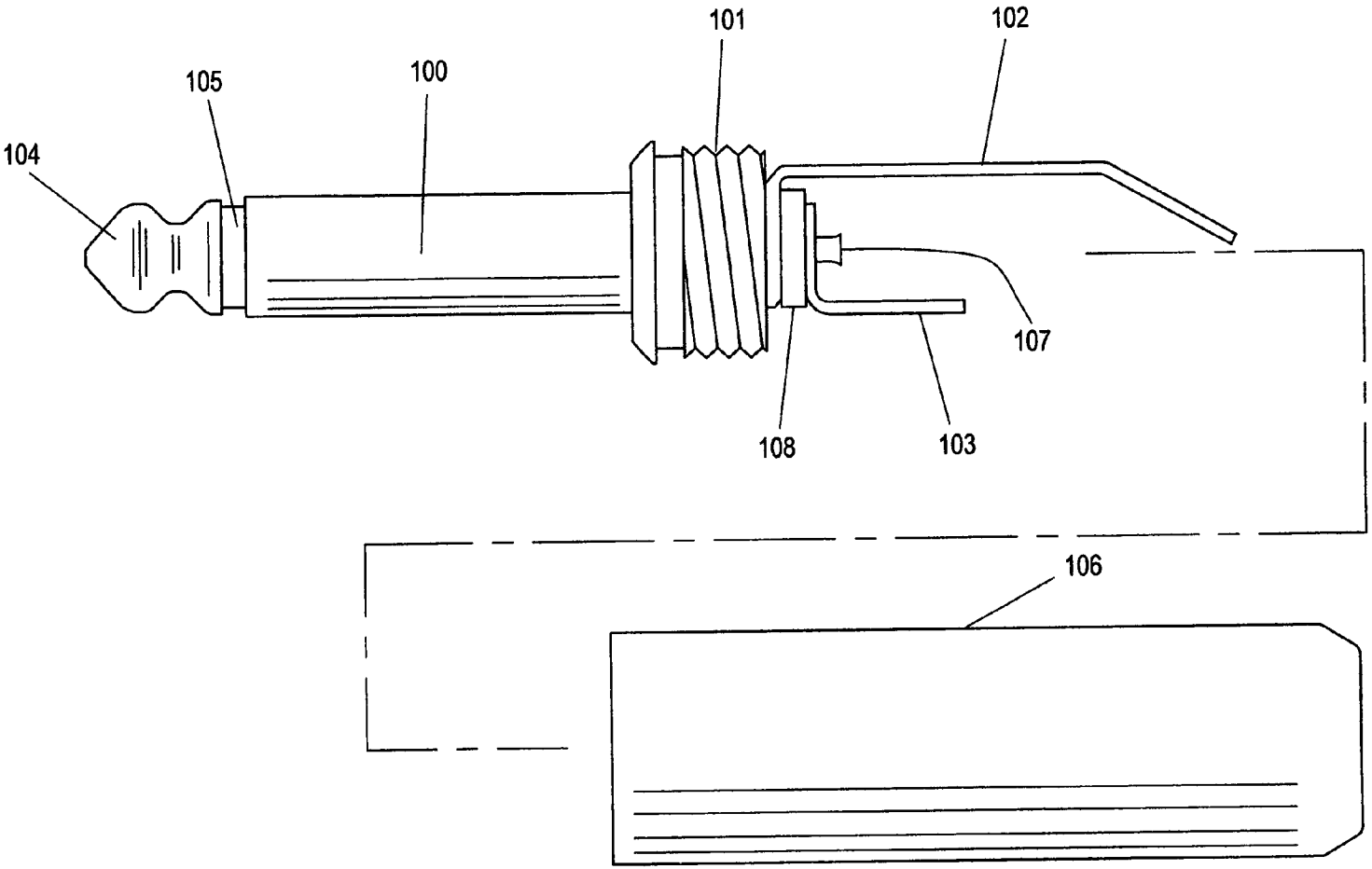
FIG. 2A (PRIOR ART)
FIG. 2A is a detailed drawing of a typical two-conductor audio connector and backshell.

FIG. 2A illustrates a detailed view of a typical male audio connector used on audio cables. The machined metal body 100 carries signal contact 104 which mates with a mating female connector, also called a jack (not shown). Signal contact 104 is the end of a metal shaft that runs through the metal body 100 (and insulated from it) and terminates in a physical attachment retainer 107, as will be seen in the sectional view of the connector in the next figure. The long barrel of the metal body 100 also mates with the mating female connector to provide a two-conductor circuit. An insulating wafer 105 separates the signal contact 104 from the metal connector body 100 near the tip of the connector.

The cable wiring terminals are implemented by metallic terminal 102, serving as a solder lug or screw terminal for a cable's shield (in the case of a low level audio cable) or ground conductor, and second metallic terminal 103, serving as a solder lug or screw terminal for a cable's signal conductor. Terminal 103 is attached by physical attachment retainer 107 to the hidden shaft of signal contact 104 by means of a swaged end, or by soldering, or by brazing, or by other techniques practiced in the art. An insulating wafer 108 insulates terminals 102 and 103 from each other. Terminal 102 comes into direct contact with the metal body 100 and is the same electrical conductor for the purposes of the electrical connection.

Metal part 100 has screw threads 101 to receive screw-on backshell 106 that protects the wired connector from damage. The backshell 106 has a circular hole in the rightmost end (as pictured) for exit of the cable from the wiring area occupied by terminals 102 and 103.

If connectors of this type are used on a driven-shield reduced capacitance audio cable, the capacitance of the entire assembly is approximately twice the capacitance of one of the connectors since the capacitance of the cable is forced to near zero. The driven shield arrangement is of no benefit in reducing the capacitance of standard connectors.

Figure 2B:
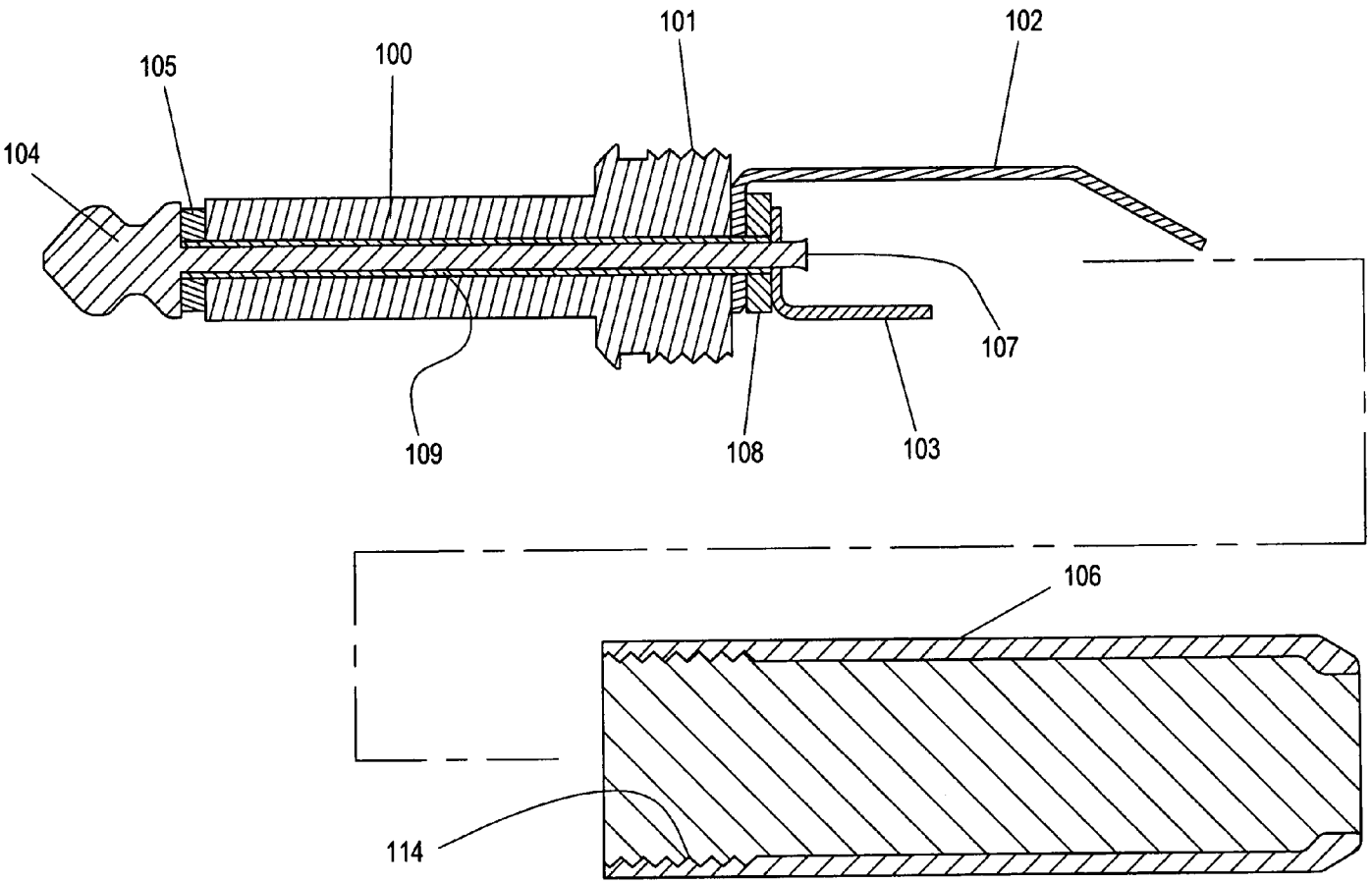
FIG. 2B (PRIOR ART)
FIG. 2B is a sectional drawing of the audio connector and backshell shown in FIG. 2A.

FIG. 2B illustrates a sectional view of the connector and backshell in FIG. 2A, to show internal detail. Fully shown here is the signal contact 104 whose shaft runs the length of the metal body 100. An insulating tube 109 serves to insulate the shaft of signal contact 104 from the metal body 100. Physical attachment retainer 107 involves modification of the end of the shaft of the contact 104 by means of swaging, soldering, brazing, or other technique practiced in the art. Threads 114 inside the backshell 106 are also shown, and these mate with the screw threads 101 on the connector.

From the figure it is apparent that there is a capacitor structure formed by the shaft of signal contact 104 and metal body 100. This capacitance reduces the high frequency response of signals passing through the connector.

Preferred Embodiment

Figure 3:
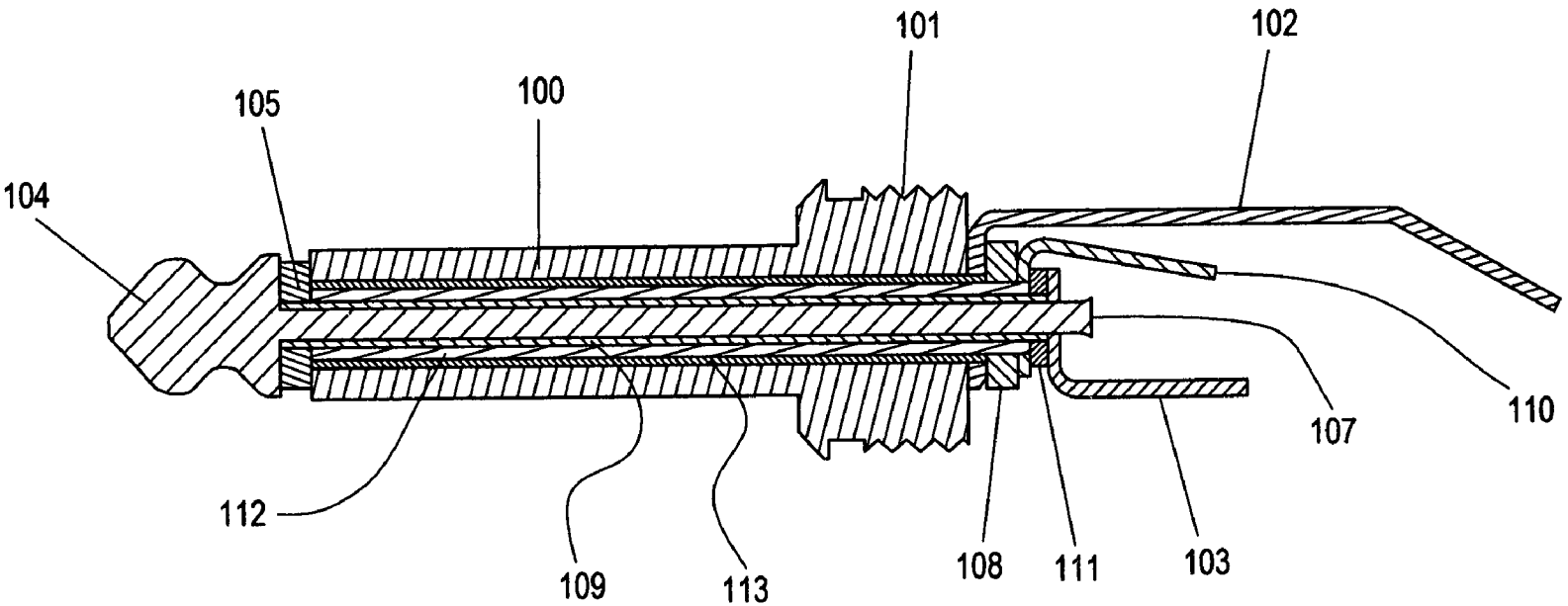
FIG. 3 is a sectional drawing of a low capacitance audio connector.

FIG. 3 illustrates the preferred embodiment, an improved connector structure whereby this capacitance may be compensated for by an external circuit, a driven shield arrangement. The improvement rests in the addition of another tubular conductor 112, insulated from the signal conductor 104 (by insulator 109) and the metal body 100 (by an insulator 113). The conducting tube 112 is attached by pressing, soldering, brazing or other well-known technique to a metallic terminal 110, which serves as a wiring terminal for a driven shield signal from an external circuit. Metallic terminal 110 is insulated from terminal 102 and terminal 103 by insulating wafers 108 and 111, respectively. The interposing of this additional conducting tube 112, along with the driven shield circuit arrangement, reduces the capacitance of the connector from typically 15 pf to only a couple picofarads.

The specific dimensions of signal conductor 104, tubular conductor 112, and the insulators 109 and 113 are not critical from an electrical perspective because the driven shield technique reduces the capacitance of the connector irrespective of those dimensions. Therefore, an advantage of this low capacitance audio connector is that the physical dimensions of the components of the connector may be chosen to optimize manufacturability, cost, durability, or other factors, without regard to the natural capacitance of the structure.

This structure is, to the right of the threads 101 in the figure, similar to the structure of a typical three-conductor (or stereo, or tip-ring-sleeve) audio plug. However, the structure near the tip of the connector and the insulator 105 is different, with there being no 'ring' contact exposed to the outside world. The assembly technique for the present low capacitance audio connector is very similar to that of a typical three-conductor audio plug, once the parts are machined to the proper shape, allowing present assembly equipment to be used to construct the new low capacitance connector.

Note that the critical innovation here is the addition of the driven shield conductor 112 between the signal conductor 104 and the return or ground conductor 100 (the metal connector body). The specific methods for the machining, assembly and retention of the parts are numerous in the prior art. The overall structure of the connector may be quite varied, as long as the driven shield conductor 112 is interposed between the signal conductor 104 and the return or ground conductor 100 (the metal connector body). This innovation is applicable to any male audio connector of this general shape, whether with a standard 6.35 mm, 3.5 mm, or 2.5 mm barrel diameter, or some other dimension.

Applications

Figure 4:
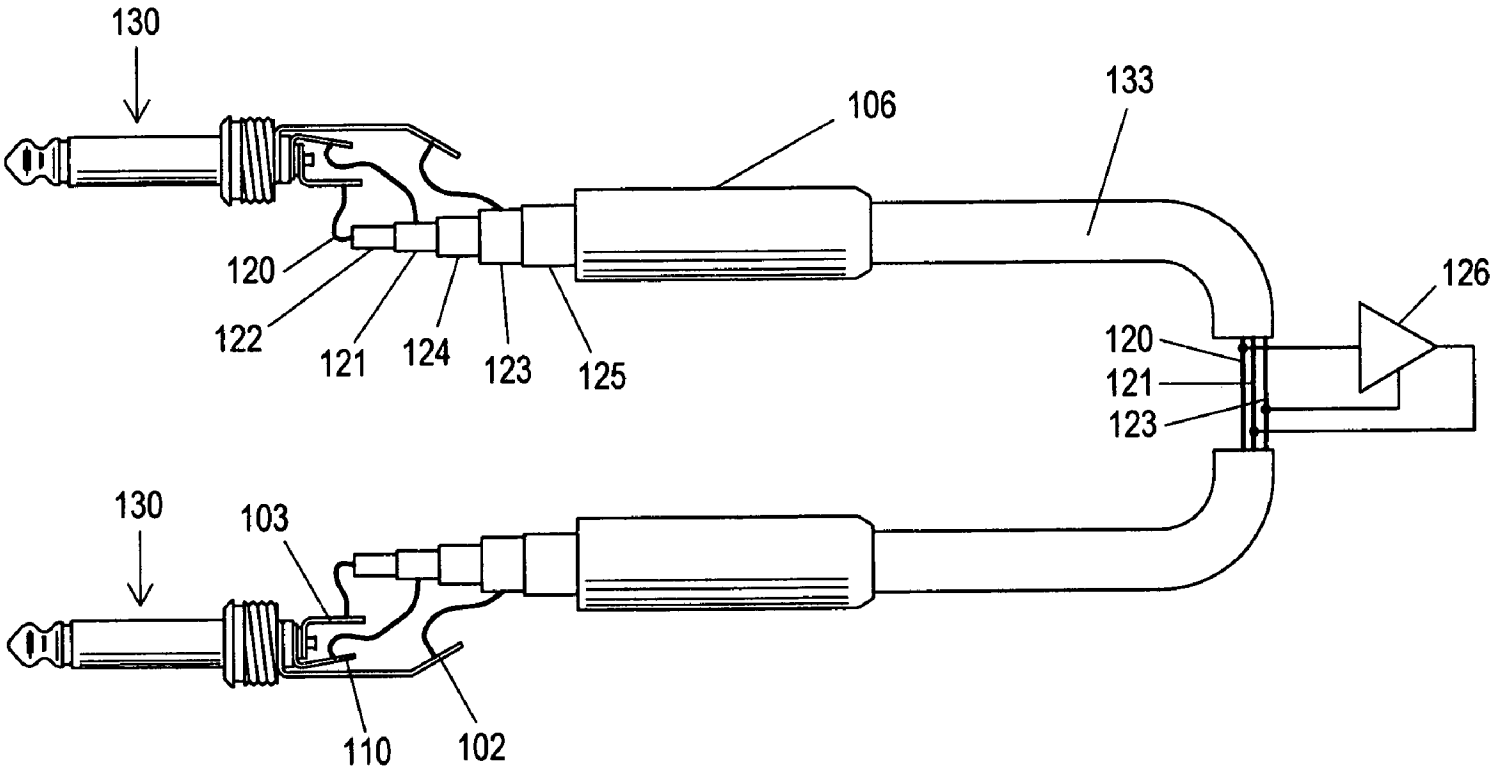
FIG. 4 is a diagram illustrating a driven shield audio cable system employing two low capacitance audio connectors, with the shield driver amplifier mounted on the audio cable.

FIG. 4 is a diagram illustrating a driven shield audio cable system employing two low capacitance audio connectors 130 (internal structure as depicted in FIG. 3), with a shield driver amplifier 126 mounted on a triaxial audio cable 133. The triaxial cable 133 has a first center conductor 120, an inner shield conductor 121 situated around the first center conductor and separated from it by a dielectric material 122, and an outer shield conductor 123 situated around the inner shield conductor 121 and separated from it by a yet additional dielectric material 124. There is an overall insulating layer 125 around the outer shield 123. The outer shield conductor 123 could be implemented as a single wire, but is shown here as a tubular shield.

The center conductor 120 carries the signal within the cable 133, and is connected to a wiring terminal 103 on the connector 130 at each end of the cable. Similarly, the outer shield 123 is connected to a wiring terminal 102 on the connector 130 at each end of the cable 133. The inner shield 121 is connected to a wiring terminal 110 on the connector 130 at each end of the cable. The capacitance reduction is provided by amplifier 126, which is typically a unity gain buffer serving as a low impedance driver, driving a one-to-one replica of the signal on the center conductor, but this amplifier could be another transfer function to accomplish a desired frequency response of the connector and cable assembly.

The amplifier 126 is shown mounted near the center of the cable assembly, but it can be mounted at any position along the cable, or even within either connector backshell. Not shown are shielding around the amplifier 126, powering of the amplifier 126, or the physical mounting means of the amplifier 126, which are immaterial to the low capacitance audio connector.

The reduction to zero of the AC voltage between the inner shield 121 and center conductor 120 results in zero AC current flowing between the center conductor 120 and the outer shield conductor 123, just the condition that would occur if the capacitance were zero. This benefit is carried through to the tip of each connector due to the additional shield 112 (shown in FIG. 3), and as a result the capacitance of the entire cable assembly falls to just a few picofarads.

Figure 5:
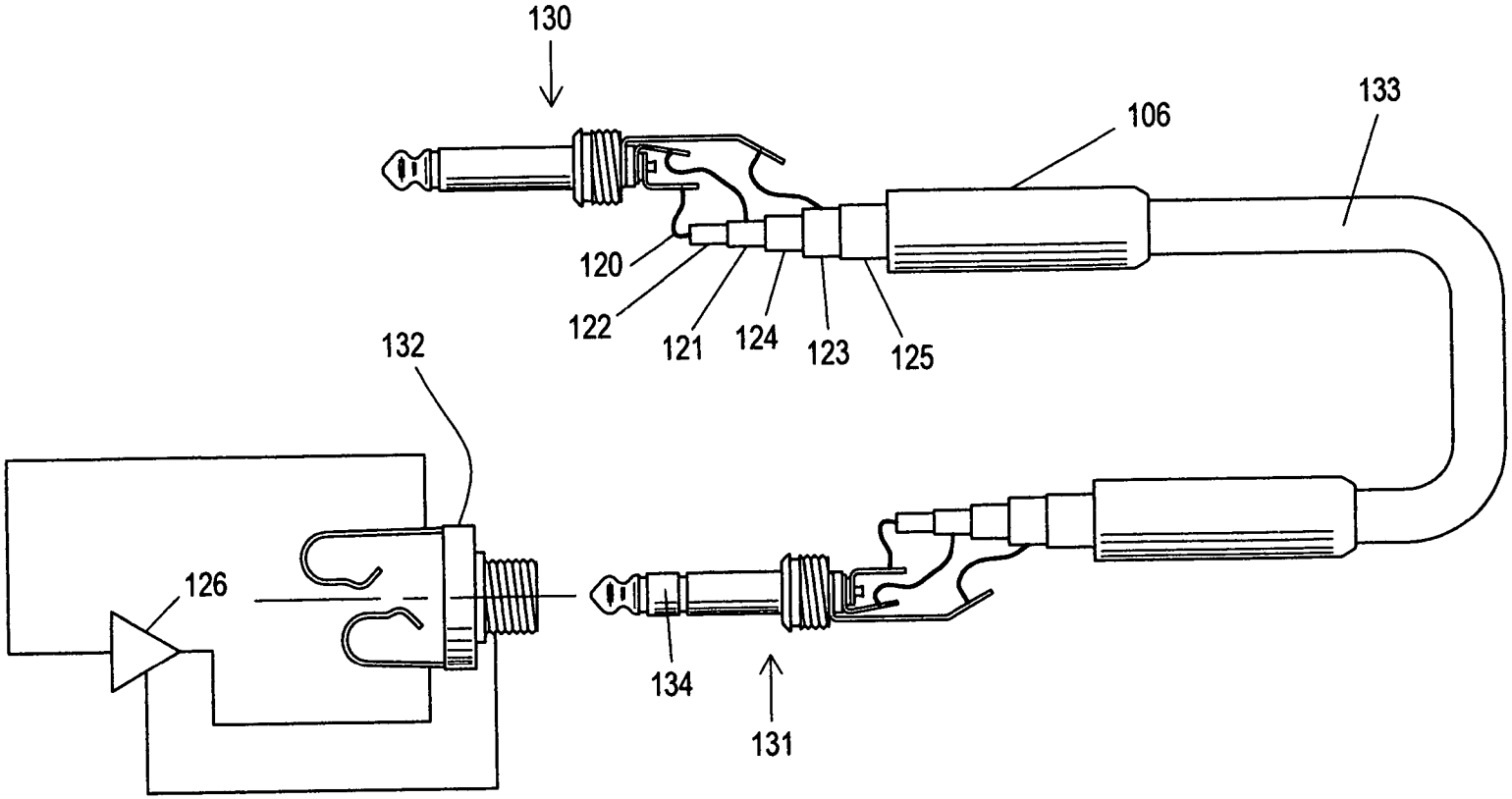
FIG. 5 is a diagram illustrating a driven shield audio cable system employing one low capacitance audio connector, and one standard three-conductor connector, with the shield driver amplifier external to the audio cable and connected to the three-conductor connector through a mating three-conductor jack.

FIG. 5 shows an arrangement whereby the shield driver amplifier 126 is external to triaxial audio cable 133. A standard three-conductor connector 131 is used at one end of the cable 133. An additional conductor 134 is used as a connection to the shield driver amplifier 126, disposed in the equipment to which the cable assembly connects, represented by a three-conductor jack 132 (wiring lugs not shown). Another connector 130 on the cable 133 is a low capacitance audio connector, wired as described in the discussion of FIG. 4. This arrangement has the advantage of allowing convenient mounting of the shield driver amplifier 126 external to the cable 133 while providing full capacitance reduction. This is because the three-conductor connector 131 has an internal structure similar to the present low capacitance audio connector, though it has an exposed third conductor 134 on the shaft.

Note that FIG. 4 and FIG. 5 illustrate the electrical connections and not the final physical form of the cable assemblies. Backshells 106 are screwed onto the connector threads after typically stabilizing the soldered connections with insulating material such as heat shrinkable tubing. Such assembly techniques are common in the art.

Note that the standard three-conductor connector 131 is not suitable for use as a low capacitance audio connector on a cable with an integral shield driver amplifier because the shield driver signal would be exposed on conductor 134 and thus susceptible to shorting or loading. Thus the construction of the low capacitance audio connector 130 hides and protects the driven shield conductor from such exposure at the mating connector interface. That interface is the surface of the low capacitance audio connector that mates with a female connector, specifically the surfaces of the signal conductor 104 and the metal body 100 which are visible with backshell 106 installed.

Note also that the configuration shown in the drawings can just as well be applied to right-angle plug connectors, and other physical variations, which are equivalent electrically.

Marketing by applicant of an audio cable featuring the low capacitance audio connector, after the filing of U.S. Provisional Application No. 61/135,974, has resulted in comments from professional musicians praising the enhanced tonal range that it provides, after they have purchased and used an embodiment of the cable.

The specific configuration of the embodiments discussed should not be construed to limit implementation of the low capacitance audio connector to those embodiments only. The techniques outlined are applicable to embodiments in other physical formats, using various power sources, and using various electronic amplifier and transfer function topologies. The low capacitance audio connector is functional with the broad range of instruments used by musicians, which convey sound signals from instrument to an amplifier and loudspeaker, or processing equipment. The amplifier or transfer function can be built into a musical instrument amplifier, musical instrument, or mounted on the audio cable itself or its attached connectors. These techniques, structures and methods find applicability outside the realm of musical instruments and related amplification, including but not limited to industrial electronics applications. Therefore, the scope of the invention should be determined not by the embodiments illustrated, but by the appended claims and their legal equivalents.

What is claimed is:

1. An audio connection means, which comprises:

(a) a first electrical conductor, having a wiring terminal, and having a surface exposed for connecting to a mating connector; and (b) a second electrical conductor situated as a shield around said first electrical conductor, separated by a first dielectric therefrom, having a wiring terminal, not having a surface exposed for connecting to a mating connector; and (c) a third electrical conductor situated as a shield around said second electrical conductor, separated by a second dielectric therefrom, having a wiring terminal, and having a surface exposed for connecting to a mating connector;

whereby said audio connection means is usable with a driven shield system to reduce the capacitance between said first electrical conductor and said third electrical conductor.

2. A method of reducing interelectrode capacitance in an audio connector having at least a signal conductor and a ground return conductor, which comprises the steps of:

(a) interposing a shield conductor between said signal conductor and said ground return conductor, said shield conductor having a wiring terminal; and (b) hiding said shield conductor from exposure at the mating connector interface; and (c) driving said shield conductor with a one-to-one replica of the signal on said signal conductor;

whereby said interelectrode capacitance between said signal conductor and said ground return conductor is reduced.

3. A method of reducing interelectrode capacitance in an audio connector having at least a signal conductor and a ground return conductor, which comprises the steps of:

(a) interposing a shield conductor between said signal conductor and said ground return conductor, said shield conductor having a wiring terminal; and (b) hiding said shield conductor from exposure at the mating connector interface; and (c) driving said shield conductor with the signal on said signal conductor as processed by an electronic transfer function;

whereby said interelectrode capacitance between said signal conductor and said ground return conductor is modified electronically to accomplish a desired frequency response.

* * * * *